United States Patent [19]

Rowland et al.

[11] 3,958,932

[45] May 25, 1976

[54] FLAME-RESISTANT TEXTILES THROUGH FINISHING TREATMENTS WITH VINYL MONOMER SYSTEMS

[75] Inventors: Stanley P. Rowland; Florine A. Blouin, both of New Orleans, La.

[73] Assignee: The United States of America as represented by the Secretary of Agriculture, Washington, D.C.

[22] Filed: Aug. 28, 1974

[21] Appl. No.: 501,418

[52] U.S. Cl. ..... 8/115.7; 8/115.5; 8/116 P; 8/184; 8/190; 8/194

[51] Int. Cl.[2] ..... D06M 13/44; D06M 13/46

[58] Field of Search ..... 8/116 P, 184, 115.7, 8/115.5, 190, 194

[56] References Cited

UNITED STATES PATENTS

| | | | |
|---|---|---|---|
| 2,861,901 | 11/1958 | Reeves et al. | 117/136 |
| 2,927,050 | 3/1960 | Reeves et al. | 154/133 |
| 3,423,163 | 1/1969 | Magat et al. | 8/184 |
| 3,658,458 | 4/1972 | Gale | 8/184 |
| 3,669,610 | 6/1972 | Friedman | 8/116 P |
| 3,700,403 | 10/1972 | Nachbur et al. | 8/116 P |
| 3,709,940 | 1/1973 | Flugel | 117/136 |
| 3,762,865 | 10/1973 | Weil | 8/116 P |

*Primary Examiner*—Murray Tillman
*Assistant Examiner*—A. H. Koeckert
*Attorney, Agent, or Firm*—M. Howard Silverstein; Salvadore J. Cangemi

[57] ABSTRACT

Water-soluble finishing systems that contain polymerizable vinyl monomers, reactive-or-coreactive phosphorus-containing organic compounds, and nitrogen-containing compounds are used to treat cellulose fiber and/or synthetic fiber structures to produce products that are flame resistant and have other desirable performance properties.

6 Claims, No Drawings

FLAME-RESISTANT TEXTILES THROUGH FINISHING TREATMENTS WITH VINYL MONOMER SYSTEMS

BACKGROUND OF THE INVENTION

This invention relates to flame retardant cellulose fiber and/or synthetic fiber structures containing phosphorus and nitrogen and to processes for introducing and fixing the chemical reagents containing phosphorous and nitrogen in the fibrous structures.

It is known to treat textiles, particularly textile materials of cellulosic fibers, with a variety of phosphorous-containing organic compounds. Known materials of this type include, for example, tris(aziridinyl)phosphine oxide, tetrakis(hydroxymethyl)phosphonium chloride, and tris (2,3-dibromyopropyl)phosphate. Background information is summarized in "The Chemistry and Use of Fire Retardants" by J. W. Lyons, Wiley-Interscience Publishers, New York, 1970.

Particular difficulties arise in flameproofing textiles of mixed fiber content, such as blends of cotton and polyethylene terephthalate fibers. The state of the art is summarized by G. S. Tesoro in *Textile Chemists and Colorists*, 5 (11), 253 (1973); impregnation of fabrics with known chemical finishing systems is not completely satisfactory in practice (a) for treatment of fabrics containing blends of cotton and polyester fibers, (b) for achievement of high levels of effectiveness and permanance of the flame retarding agents, (c) for retention of the aesthetic characteristics of the original unmodified fabric, (d) for development of flame retardancy together with durable press performance properties, and (e) for retention of high levels of strength properties in the chemically-modified, flame-retardant fabric.

Processes for improving textiles composed of cellulose fibers and synthetic fibers have been suggested in which the textiles are subjected to the combined action of tetrakis(hydroxymethyl)phosphonium salts and halogenated alcohols, aldehydes, amines, ketones, and/or carboxylic acids ("The Chemistry and Uses of Fire Retardants," J. W. Lyons, Wiley-interscience Publishers, 1970). Polymerizable compounds such as acrylamide can also be used in combination with tetrakis(hydroxymethyl)phosphonium chloride (THPC). In flameproofing of substrates such as wood (U.S. Pat. No. 2,927,050, J. D. Guthrie). Bis (2-chloroethyl) vinylphosphonate can be copolymerized with acrylamide, N-methylol acrylamide, or acrylonitrile on polypropylene fibers to achieve the flame retardancy (A. Adler and W. Brenner, Nature, 225, 60 (Jan. 3, 1970)). Organic phosphorus compounds resulting from the combination of two moles of THPC with one mole of N-methylol acrylamide may be prepared and subsequently applied to textiles, especially those including cellulosic fibers, for the purpose of flameproofing (U.S. Pat. No. 3,709,940, W. Flugel).

These and related processes of the prior art leave much to be desired in satisfying the requirements enumberated above. In addition, the above reactions utilizing vinyl monomers involve a pre-polymerization or pre-reaction of these monomers with other reagents prior to application to the fabric (cf. Guthrie and Flugel). In other cases the application of the vinyl monomer to the fabric necessitates the use of supplementary solvents (cf. Adler and Brenner), low efficiency of conversion of monomers to fixed polymer, and relatively low durability of the effectiveness of the treatment.

The objects of this invention are: (a) chemical finishing treatments that may be applied to textile fabrics from totally aqueous systems without the necessity for employing supplementary solvent materials in order to produce improved flame-retardant textiles and (b) chemically-modified textile products that exhibit high flame retardancy-high permanency of the effects of the treatment, combinations of durable press properties with flame retardancy, and good retention of strength properties of the textile composition.

SUMMARY OF THE INVENTION

It has been found that certain combinations of polymerizable monomers containing phosphorus and nitrogen, at least one of which monomers is capable of vinyl polymerization, may be applied to fabrics from totally aqueous solutions and may be cured in the fabric to durable, solvent-resistant, flameretardant textile products. The treatment is especially suitable for cotton fibers and cellulose/synthetic fiber blends such as cotton/polyethylene terephthlate fiber blends. Unique features of these processes and the products developed therefrom include the applicability and suitability of the process for blends, the development of durable-press performance characteristics together with flame retardancy, the retention of high levels of strength in the fabric, and the durability of the finishes to extraction by organic solvents (e.g., drycleaning agents) or multiple launderings. The textile fabrics, especially cellulosic/polyester blend fabrics, are rendered durably flame retardant by fixation or cure following impregnation with:

a. Tetrakis(hydroxyemthyl)phosphonium chloride; acrylamide or N-methylol acrylamide; preferably with urea, N-methylol-urea, or a methylolated melamine; and preferably with methylenebis-acrylamide or 1,3,5-triacryloylhexahydro-s-triazine.
b. Bis(2-chloroethyl) vinylphosphonate; acrylamide or N-methylol acrylamide; preferably urea, N-methylol urea, or methylolated melamine; methylenebisacrylamide or 1,3,5-triacryloylhexahydro-s-triazine; alkali metal or ammonium persulphate.
c. Combinations of (a) and (b).

DETAILED DESCRIPTION OF THE INVENTION

This invention provides a method of rendering cellulosic fabrics, cellulosic/synthetic fiber blend fabrics, synthetic fiber fabrics, and especially cotton/polyester blend fabrics flame retardant by impregnation of the fabrics with chemical systems A, B, or C:

System A: Tetrakis(hydroxymethyl)phosphonium chloride (THPC); acrylamide or N-methylol acrylamide; urea, N-methylol urea, or methylolated melamine; methylenebisacrylamide (MBA) or 1,3,5-triacryloylhexahydro-s-tetriazine (THT). The reagents may be introduced into the pad bath individually or the THPC may be pre-reacted with the urea, urea derivative, or melamine derivative prior to introduction into the solution.

System B: Bis(2-chloroethyl) vinylphosphonate; acrylamide or N-methylol acrylamide; urea, N-methylol urea, or methylolated melamine; MBA or THP; and alkali metal or ammonium persulphate. The reagents may be introduced into the aqueous solution as individuals or the acrylamide or N-methylol acrylamide may be reacted to form a pre-condensate with the urea, urea derivative, or melamine derivative prior to introduction into the solution with the outer reagents.

System C: Combinations of System A and System B. In these combinations it is desirable to eliminate the persulfate component of System B unless System A constitutes a very small portion of the total combination of the two systems.

Reaction products from the above reagent systems are insolubilized or fixed in and on the textile fiber structure during curing periods which are conducted at elevated temperature.

The chemicals of systems A and B form insoluble polymer systems by virtue of the molecular weight, the three-dimensional structure, the chemical composition, or the developments of linkages to the polymer of which the fiber is constituted. These insolubilized products from Systems A and B or combinations of A and B are essential to the development of the desired flame retardancy and also essential to the development of supplementary performance characteristics in the chemically-modified fabric structures. The particular and specific nature of the combination of reagents in Systems A and B, or in combinations of Systems A and B, is such as to provide for the development of flame retardancy together with high levels of durability of the treatment, high levels of resiliency or durable-press performance characteristics, and unique retention of or improvement of strength properties.

Although the above systems are unique and essentially complete in themselves, it may be appropriate under certain circumstances to introduce, as supplementary materials, conventional additives such as softeners, lubricants, and crosslinking reagents.

All of the components of chemical Systems A, B and C can be applied from a single aqueous solution to the fabric structure and the desirable insoluble products and textile properties can be developed during a curing reaction at elevated temperature. Thus, for instances, all of the chemicals for a given system can be applied from a single aqueous reagent system such as by padding fabric with an aqueous solution, and then the desired insoluble products form simultaneously in a single curing step. Alternatively, the reagents of one system, for instance, System A, can be applied to the fabric, and insoluble product be formed by curing, and then the chemicals of another system, for instance System B, can be added and insolubilized.

The compounds of System A form a polymeric product containing phosphorus and nitrogen that are insolubilized and fixed in and on the fiber structure. The insoluble product can be formed in the fabric by the reaction of THPC, acrylamide or N-methylol acrylamide (or methacrylamide or N-methylol methacrylamide), urea (N-methylol urea or methylolated melamine), and MBA (or THT). Alternatively there can be applied to the fabric a solution that consists of a precondensate of THPC with urea (or N-methylol urea or methylolated melamine) together with MBA (or THT).

The compounds of System B also form an insoluble product containing phosphorus and nitrogen bound or fixed in the fiber structure. The insoluble product can be formed by dissolution of bis(2-chloroethyl) vinylphosphonate in a solution of acrylamide or N-methylol acrylamide (or methacrylamide or N-methylolmethacrylamide), and urea (or N-methylol urea or methylolated melamine) to which are added MBA (or THT) and a persulfate catalyst. Alternately, in place of THPC and the urea (or N-methylol urea or methylolated melamine) there can be introduced into the reaction mixture a precondensate of these materials such as, for instance, that from acrylamide and N-methylol urea (or methylolated melamine) or that from N-methylol acrylamide and urea.

The compounds of System C form insoluble products that bind and fix phosphorus, nitrogen, and halogen in the fibrous structure. The insoluble product can be formed by applying to fabric structures combinations of System A and System B as described above. In such cases, it is essential for stability of the reagent system and controlled reactivity of the reagents on the fabric that the persulfate catalyst of System B be omitted, unless the components of System B and the persulfate catalyst are present, respectively, at concentrations that are very low.

Fabrics impregnated with the reagents of Systems A, B, and C may be cured to form insoluble polymeric phosphorus-and nitrogen-containing products with or without a pre-drying period at a temperature in the range of 50°C to 85°C for several minutes and with a cure conducted in air, steam, or inert gas at a temperature in the range of 100° to 200°C for approximately 20 to 0.5 minutes in a dry state. The generally preferred conditions for System A involve a cure for a period of a few minutes at a temperature in the range of 140°-180°C following a drying period at a temperature near 70°C. The insolubilization, polymerization, and fixation of the reagents in System B can be achieved by curing conditions described above; however, preferred conditions involve a curing period in an atmosphere of steam for a duration of a few minutes. The reagents of System C may be cured to insoluble polymeric products under the condition described above; the preferred conditions involve a preliminary drying at a temperature near 70°C for a duration of a few minutes followed by a cure at a temperature in the range of 140°–180°C.

In the present invention acrylamide is essentially equivalent to methacrylamide; and N-methylol acrylamide is essentially equivalent to N-methylol methacrylamide. Supplementary nitrogen-containing compounds are best employed as follows: urea in combination with N-methylol acrylamide or N-methylol methacrylamide; N-methylol urea or methylolated melamine in combination with acrylamide or methacrylamide. MBA and THT are generally equivalent in their contribution when the latter replaces the former on an equivalent basis, i.e., the latter being trifunctional and the former being difunctional.

Conventional finishing agents may be employed to supplement reagent Systems A, B, and C in order to accentuate specific qualities in the final fabric. Thus, conventional lubricants, softeners, and crosslinking agents may be introduced into the reagent system; examples of these are polyethylene glycols, fatty acids, fatty acid esters of polyethylene glycols, polyethylene emulsisons or dispersions, dimethylol alkyl carbamates, and dimethyloldihydoxyethyleneurea.

The contributions of the various components of System A to the finishing system and to the final textile product appear to be as follows: THPC supplies a water-soluble form of phosphorus for fixation to the fibrous compositions; the acrylic amide (or derivative) acts as a primary coreactant and fixing agent for the THPC; the acrylic amide (or derivative), urea, and methylolated amide supply nitrogen to the final product; MBA (or THT) serves as a supplementary corectant that raises the efficiency of fixation of phosphorus and nitrogen in the polymer composition and that improves the durability of the finish in the fabric.

Contributions of components of System B appear to be as follows: BVP supplies phosphorus (and also halogen) for fixation tc the fibrous structure; the acrylic amide (or derivative) serves as a primary coreactant, a solubilizer for BVP, and a supplier of nitrogen in the insolubilized, fixed polymer; the urea and methylolated amide appear to serve as secondary coreactants, solubilizers for BVP, and sources of nitrogen for fixation in the final polymer; MBA and THT serve the same purpose as already indicated for System A; the alkali metal or ammonium persulphate serves as a free-radical initiator for the vinyl polymerization.

Contributions of components of System C are believed to be generally similar to the contributions of the same components to Systems A and B; however, the system and the situation is substantially more complex, as indicated by the fact that a radical initiator is not essential in this system, as was the case in System A.

Several aspects of the reactions of this invention are surprising and unpredictable. Although it is known that N-methylolacrylamide may be fixed or polymerized in cotton fiber structures by two-stage processes, for instance a basecatalyzed reaction followed by an acid-catalyzed reaction on the one hand or, on the other hand, a high-energy irradiation catalyzed reaction followed by an acid-catalyzed reaction or vice versa, and that the products of these reactions exhibit resilience and durable-press performance properties, it is not known that N-methylol acrylamide can be fixed or polymerized in cotton to develop these performance properties in a single stage reaction and in combination with a fixation of THPC. In addition, it is not known that the vinyl-type polymerization of N-methylol acrylamide (or the equivalent replacement monomers) can be conducted on a fabric in the absence of a free-radical catalyst and in the presence of air. Finally, it is outside the scope of predictability that attractive combinations of flame retardancy and durable-press performance properties can be achieved in such reactions and, especially, together with unique high retention of strength properties. While it is known to polymerize bis(2-chloroethyl) vinylphosphonate by free-radical catalysis, it is not known that this monomer can be completely solubilized in aqueous media when combined with the nitrogen-containing reagents described in this invention. It is especially surprising that high levels of wet wrinkle recovery and smooth-line drying characteristics can be obtained in combination with flame retardancy in systems employing this vinyl monomer. Another surprising aspect of the results of finishing treatments with this monomer under the conditions described above, is the actual increase in breaking strength of the chemically finished fabric; an extensive background of literature on the chemical finishing of cotton and blend fabrics teaches that decreases in breaking strength commonly occur as the result of chemical finishing, the extent of the decrease being as large as 60%, and the effect being generally inevitable and only subject to reduction in degree. The operability of System C and the results obtained in finishing fabrics therewith emphasize the surprising aspects that are individual and specific to Systems A and B. The fact that insolubilization and fixation of reagents occur in System C appears to provide evidence that the reactions involve vinyl polymerization as well as methylol amide condensations. Vinyl polymerizations in the absence of conventional free-radical catalyst, in the presence of air and especially in a forced draft of air, and the attainment of high levels of efficiency of insolubilization and fixation are among the interesting but unpredictable aspects of this invention.

The present invention can be used with all-cellulose fabrics such as cotton fabrics, cellulose/polyester blend fabrics over the entire range of composition from essentially 100% cellulose to essentially 100% polyester, other synthetic fiber fabrics, and blends of various natural and synthetic fibers. While the invention is applicable to wool, nylon, acrylic, and spandex fabrics, it is most useful in connection with cotton/polyester blend fabric.

The following examples are provided to further illustrate the invention, but it is understood that the invention is not to be limited in any way by the details described therein. In the examples, percents and parts are by weight unless otherwise specified.

Analytical and Test Methods employed in the Examples:

Nitrogen: determined by Kjeldahl digestion followed by titration of distilled ammonia.

Phosphorus: determined by colormetric analysis after digestion of the sample with strong acid.

Formaldehyde: determined by chromatropic acid method.

Vertical Flame Test: done according to Federal Test Method Std. No. 191, Method 5903.2.

Conditioned and Wet Wrinkle Recovery: done according to American Society for Testing Materials (ASTM), D-1295-67.

Breaking Strength and Elongation: done according to ASTM D-1682-64 strip (1 in.) method.

Match Test: done according to W. A. Reeves, O. J. McMillon, Jr., and J. D. Guthrie, Textile Research Journal 13, 527-532 (1953).

The following examples illustrate but do not limit the scope of this invention.

EXAMPLE 1

A treating solution was prepared to contain the following materials: 15% THPC, 15% NMA, 0.5% of MBA, 5% of urea, a trace of wetting agent (Triton X-100), and 64.5% water. Samples of cotton sateen fabric were immersed in this solution and then passed through squeeze rolls to obtain 90–95% wet weight gain. The wet fabrics were placed on pin frames, sealed in bags under nitrogen, and heated for ten minutes in an oven at 120°C. The samples of fabric were removed from the bag, dried for 4 minutes at 85°C, and then cured for 4 minutes at 150°C. Finally, the fabrics were washed thoroughly in hot tap water, air dried, and analyzed. The add-on of insoluble or fixed polymer was 27.3%; the efficiency of conversion of monomers to polymer was 83%; and the match test angles of the samples were 170°–180°, i.e., the samples did not sustain a flame when a match was removed from underneath the sample which was held vertical or 10° from vertical.

EXAMPLE 2

Cotton sateen fabric was immersed in a solution consisting of 29.4% THPC, 15.6% NMA, a trace of wetting agent, and 55% water. The fabric was passed through squeeze rolls to obtain a 95–100% wet weight gain and was then placed on pin frames. After drying for four minutes at 85°C, the fabric was cured for 4 minutes at 150°C. The cured fabric was washed thoroughly in hot tap water and air dried. The add-on of insolubilized or fixed polymer was 24.4%, and the efficiency of conversion of monomers to polymer was 55.3%. Analyses showed that the fabric contained 2.3% formaldehyde, 3.0% phosphorus, and 1.6% nitrogen. The char length measured for the fabric was 4.6 inches.

When NMA was omitted from this formulation, the add-on of insoluble polymer and the efficiency of conversion of monomers to polymers were 1.2% and 4.8%, respectively. When the NMA was replaced in the foregoing formulation with urea, the add-on of polymer and the efficiency of reaction were 11.6% and 8.3%, respectively.

EXAMPLE 3

Cotton sateen fabric was treated with an aqueous solution containing 15% THPC, 7.5% urea, 7.5% TMM, and a trace of wetting agent. The fabric was padded to a 100–110% wet weight gain, placed on pin frames, dried four minutes at 85°C, and cured for 4 minutes at 150°C. After washing and drying, it was found that the efficiency of conversion of monomers to insoluble and fixed polymer was 64%. The char length for the fabric was 1.7 in.; the conditioned and wet wrinkle recovery angles were 229° and 165°, respectively, When a similar treatment of cotton sateen fabric was carried out with a solution containing 19.4% THPC, 20.6% NMA, and a trace of wetting agent, the results were as follows: the efficiency of conversion of monomers to polymer was 71%; the char length was 5.2 in.; the conditioned and wet wrinkle recovery angles were 316° and 292°, respectively.

When the cotton sateen was treated with a reagent solution containing 19.4% THPC, 10.3% NMA, 6.1% urea, and a trace of wetting agent, the results were as follows: the efficiency of conversion of monomers to insoluble and fixed polymer was 71%; the char length was 3.1 in.; the conditioned and wet wrinkle recovery angles were 262° and 257°, respectively.

EXAMPLE 4

Cotton sateen fabrics were treated with solutions containing THPC, NMA, MBA, and a trace of wetting agent as indicated in Table I The Fabrics were immersed in the treating solution, padded to 100–110% wet weight gains, and placed on pin frames. After drying for four minutes at 85°C and curing for 4 minutes at 150°C, the samples were washed and air dried. Results are summarized in Table I.

TABLE I

| | TREATED FABRICS | | | | | |
|---|---|---|---|---|---|---|
| Treating Solution[1] | Add-on | Efficiency | Char Length | Wrinkle Recovery W+F (Degrees) | | Breaking Strength Retained |
| MBA (%) | (%) | (%) | (in) | Cond. | Wet | (%) |
| 0 | 28.9 | 71.3 | 5.2 | 316 | 293 | 87.6 |
| 0.5 | 31.1 | 73.7 | 3.8 | 308 | 292 | 84.5 |
| 1.0 | 33.7 | 77.1 | 3.4 | 309 | 284 | 78.7 |

[1]Treating solutions contained 19.4% THPC, 20.6% NMA and the indicated quantities of MBA

EXAMPLE 5

Treating solutions containing various ratios of THPC, NMA, and urea were prepared according to the listing in Table II. Samples of fabric were immersed in these solutions, padded, dried, cured, washed, and dried as described in Example 4. Results are summarized in Table II.

TABLE II

| TREATMENT CONDITIONS | | | | |
|---|---|---|---|---|
| THPC, % | 19.4 | 19.4 | 19.4 | 19.4 |
| NMA, % | 20.6 | 15.4 | 10.3 | 5.2 |
| Urea, % | 0.0 | 3.1 | 6.1 | 9.1 |
| Mole Ratio, THPC:NMA:Urea | 1:2:0.0 | 1:1.5:0.5 | 1:1:1 | 1:0.5:1.5 |
| RESULTS ON TREATED FABRICS | | | | |
| Add-on, % | 28.9 | 26.5 | 23.1 | 14.1 |
| Efficiency, % | 71.3 | 74.1 | 70.8 | 49.1 |
| Char Length, Inches | 5.2 | 3.8 | 3.1 | BEL[1] |
| Wrinkle Recovery, W+F | | | | |
| Conditioned | 316 | 296 | 263 | 246 |
| Wet | 293 | 277 | 207 | 11 182 |
| Breaking Strength Retained, % | 87.6 | 80.6 | 68.5 | 67.2 |

[1]BEL = burned entire length

EXAMPLE 6

Cotton sateen fabric was treated in a reagent solution consisting of 15% THPC, 15% acrylamide, 0.5% MBA, and a trace of wetting agent. The wet weight gains, drying procedure, curing procedure, washing and drying were the same as those described in Example I. The results were as follows: Efficiency 26.2%; char length 10.1 inches; conditioned and wet wrinkle recovery angles were 220° and 278°, respectively; the retention of breaking strength was 50.4% of that of the original fabric.

The introduction of 5% TMM into the reagent solution described just above caused some of the results to change as follows: Efficiency 69%; char length 3.4 inches; conditioned and wet wrinkle recovery angles 261° and 292°, respectively; and retention of breaking strength 64%.

EXAMPLE 7

Samples of sateen fabric were treated in reagent solutions consisting of 15% THPC, 15% NMA, 5% urea, 0.5% MBA, and a trace of wetting agent; a similar reagent bath contained 2% solids of polyethylene softener in addition to the listed materials. Wet fabrics were squeezed to approximately 100% wet weight gain and treated as follows: Samples treated without softener were sealed in plastic bags containing an atmosphere of nitrogen, placed in a forced draft oven for 10 minutes at 120°C, dried for four minutes at 85°C, and finally treated for 4 minutes at 150°C. The other set of samples of fabric that was treated in the reagent solution containing softener was dried for four minutes at 85°C and cured for four minutes at 150°C. Both sets of fabrics were washed thoroughly and air dried prior to testing. The set of samples containing no softener and cured in stages showed a 78% efficiency of conversion of monomers to polymers, conditioned and wet wrinkle recovery angles of 281° and 272°, respectively, breaking strength retention of 84.6% of the original, and a char length of 3.6 inches. The fabrics containing softener and cured in one step showed efficiencies of 85.6% conversion of monomer to polymer, conditioned and wet wrinkle recovery angles of 292° and 273°, respectively, breaking strength retention of 80%, and char length of 4.3 inches.

EXAMPLE 8

A series of cotton, cotton/polyester blends, and polyester knit fabrics were treated with an aqueous solution containing 19.4% THPC, 10.3% NMA, 6.1% Urea, and a trace of wetting agent. The fabrics were immersed in the treating solution, padded to 105-120% wet weight gains and placed on pin frames. After drying four minutes at 85°C and curing four minutes at 150°C, the samples were washed and air dried. Results are summarized below.

TABLE III

| Fabric Type | | Treated Fabrics | | |
|---|---|---|---|---|
| Cotton (%) | Polyester (%) | Add-on (%) | Efficiency (%) | Char Length (in.) |
| 100 | 0 | 27.0 | 61.1 | 2.1 |
| 80 | 20 | 28.4 | 66.6 | 2.8 |
| 30 | 70 | 26.9 | 72.2 | 4.0 |
| 0 | 100 | 28.0 | 73.8 | 4.7 |

The treated fabrics were subjected to extraction with hot tetrachloroethylene. No significant weight losses were observed. Char lengths on the extracted samples were unchanged from those of the original samples, except in the case of the 100% polyester fabric, in which case the char length was greater than 5 inches after extraction.

EXAMPLE 9

Cotton and polyester knit fabrics were treated with an aqueous solution containing 32.7% THPC, 17.3% NMA and a trace of wetting agent. Samples were padded, dried, cured and washed as in Example 8. The following results were obtained: Cotton knit, 26.8% add-on and 3.3 inches char length; polyester knit, 17.8% add-on and 2.5 inches char length.

EXAMPLE 10

Cotton fabric was treated with a solution of reagents containing 19.4 parts of THPC, 20.6 parts of NMA, 0.6 parts of THT, 0.1% of ethylenediaminetetraacetic acid and a trace of wetting agent. The procedure was that described in Example 3. The add-on of polymer onto the cotton was 22.4% and the efficiency of reaction was 60%.

EXAMPLE 11

Cotton fabric was treated in a reagent solution containing 31.2% THPC, 18.8% N-methylolmethacrylamide, and a trace of wetting agent. Fabric was processed essentially as described in Example 4. The add-on obtained was 18.9% and the efficiency of reaction was 32.9%. The vertical flame test on this product gave a char length of 2.5 inches.

EXAMPLE 12

When cotton fabric was treated as in Example 4 with a solution containing 19.2% THPC, 8.6% methacrylamide, and 7.2% TMN, the treated fabric was found to have an add-on of 17.4% and to be characterized by an efficiency of reaction of 55.7%.

EXAMPLE 13

Cotton fabric that was processed as in Example 1 after immersion in a solution containing 17.3% NMA and 32.7% THPC contained 33.5% of fixed polymer and gave a char length of 2.9 inches in the vertical flame test. After a 4-hour boil in 0.5% $Na_3PO_4.12H_2O$ solution, water washing and air-drying, the fabric showed a 2.3 inch char length.

EXAMPLE 14

A solution was prepared to contain 43.3% BVP, 25% acrylamide, 3% MBA, 1% ammonium persulfate, and a trace of wetting agent. Cotton fabric was immersed in this solution and passed through squeeze rolls to obtain a wet weight pickup of approximately 100%. The fabric was placed on a pin frame, sealed in a plastic bag containing an atmosphere of nitrogen, and subjected to a period of 10 minutes at 120°C in a forceddraft oven. After removal from the pin frame, the fabric was rinsed extensively in hot tap water and air dried. The results were as follows: Efficiency of conversion of monomers to insoluble of fixed polymer was 61%; the char length was 2.1 inches; the conditioned and wet wrinkle recovery angles were 192° and 205°, respectively; the breaking strength was 131% of that of the original unmodified cotton fabric.

When acrylamide was omitted from the formulation described above, BVP was not soluble in the aqueous medium; application to the cotton fabric was spotty, the efficiency of conversion of monomer to polymer was variable but low (below 30%), and the fabric burned the entire length.

Alkali metal persulfates are essentially equivalent to ammonium persulfate in these formulations.

EXAMPLE 15

A reagent solution was prepared to contain 25% BVP, 15% acrylamide, 10% urea, 2% MBA, 2% ammonium persulfate, and a trace of wetting agent. Wet weight gain and fabric treatments were the same as those described in Example 14. The results were as follows: Efficiency 78.3%, the char length was 3.8 inches; conditioned and wet wrinkle recovery angles were 121° and 244°, respectively; the breaking strength was 117% that of the original unmodified cotton fabric.

When 21% NMA was introduced in place of the 15% acrylamide in the reagent solution described in the first portion of this example, the results that were significantly different were as follows: Conditioned and dry wrinkle recovery angles were 245° and 253°, respectively; breaking strength was 103% that of the original unmodified cotton fabric.

When the acrylamide or NMA was cut down to a concentration of 5% in the reagent solution, the BVP was no longer completely soluble in the aqueous system even though the concentration of urea was raised to 20%. The conversion of monomer to polymer was 57% but the sample of fabric burned the entire length.

EXAMPLE 16

Cotton sateen fabric was immersed in treating solutions containing 40 or 50% BVP, 25% NMA, 25% MBA, and 2.5% ammonium persulfate. After padding to 100% wet weight gain, fabric samples were placed on pin-frames and sealed in plastic bags under an atmosphere of nitrogen. After treatment for 10 minutes at 120°C, fabrics were thoroughly washed and air dried. The following results were obtained with 40 and 50% BVP, respectively: 40.3 and 43.3% add-ons, 59 and 52% efficiencies, 243° and 240° conditioned wrinkle recoveries, 243° and 220° wet wrinkle recoveries, 100 and 97% breaking strength retained, and 3.2 and 3.3 inch char length.

EXAMPLE 17

A series of cotton/polyester knit fabrics was treated with an aqueous solution containing 43.3% BVP, 25% acrylamide, 3.0% MBA and 1% ammonium persulfate. Samples were placed on pin-frames, sealed under nitrogen and treated as described in Example 15. After washing and air drying the fabrics, the following results were obtained.

TABLE IV

| Type of Fabric Cotton (%) | Polyester (%) | Add-on (%) | Treated Fabric Efficiency (%) | Char Length (in.) |
|---|---|---|---|---|
| 100 | 0 | 65.1 | 67.4 | 2.3 |
| 80 | 20 | 70.7 | 67.8 | 2.8 |
| 30 | 70 | 65.6 | 71.0 | 2.8 |
| 0 | 100 | 59.7 | 67.3 | BEL |

EXAMPLE 18

Cotton sateen fabric strips were treated with solutions containing 25% BVP, 25% acrylamide, 2.5% ammonium persulfate and a multifunctional vinyl monomer at concentrations indicated in Table V. Fabrics were padded in the treating solutions and processed as in Example 14. Results obtained from the original treatments and the percent polymer loss from these treated fabrics on subjection to a 4-hour sodium phosphate boil are presented in Table V.

TABLE V

| Multifunctional Vinyl Monomer | | Flame Retardancy Treatment | | After Treatment[1] |
|---|---|---|---|---|
| Reagent | % | Add-on % | Efficiency % | Polymer Loss % |
| None | 0.0 | 14.2 | 32.3 | 44.0 |
| MBA | 2.5 | 35.5 | 74.8 | 3.2 |

TABLE V-continued

| Multifunctional Vinyl Monomer | | Flame Retardancy Treatment | | After Treatment[1] |
|---|---|---|---|---|
| Reagent | % | Add-on % | Efficiency % | Polymer Loss % |
| MBA | 5.0 | 44.1 | 79.8 | 1.1 |
| THT | 2.7 | 37.5 | 75.6 | 2.7 |
| Divinyl Benzene | 2.1 | 30.6 | 67.0 | 4.9 |
| STD. THPC/Urea TMM Treatment | | 16.5 | 60.4 | 15.6 |

[1]Samples subjected to a 4-hour boil in 0.5% $Na_3PO_4.12H_2O$ solution containing wetting agent.

EXAMPLE 19

Cotton sateen fabric was treated with a solution containing 15% BVP, 15% methacrylamide, 1.5% MBA, 1.5% ammonium persulfate and a trace of wetting agent. The padded fabric samples were placed on pin frames and sealed in bags containing a nitrogen atmosphere. After heating for ten minutes at 120°C, the fabric samples were washed and air dried. An add-on of 18.0% and an efficiency of conversion of monomers to polymer of 67.6% was obtained.

EXAMPLE 20

A treating solution containing 15% THPC, 15% BVP, 15% acrylamide, 10% TMM and a trace of wetting agent was prepared. Knit fabrics were immersed in this solution, padded to 115–140% wet weight gain, and placed on pin frames. Fabrics were dried 4 minutes at 85°C and cured four minutes at 150°C. The samples were washed in hot tap water and air dried. The results obtained are shown below.

TABLE VI

| Type of Fabric Cotton (%) | Polyester (%) | Add-on (%) | Treated Fabric Efficiency (%) | Char Length (in.) |
|---|---|---|---|---|
| 100 | 0 | 56.0 | 73.3 | 2.8 |
| 80 | 20 | 59.4 | 75.3 | 2.5 |
| 30 | 70 | 48.4 | 69.1 | 3.8 |
| 0 | 100 | 44.6 | 69.9 | 4.8 |

The treated fabric samples were subjected to extraction with hot tetrachloroethylene; no significant weight losses were observed. Char length of the extracted samples were unchanged from the lengths obtained originally, except in the case of the 100% polyester fabric which gave a char length greater than 5 inches after extraction.

EXAMPLE 21

A series of cotton/polyester knit fabrics was immersed into a solution containing 15% THPC, 15% BVP, 15% NMA, 5% urea, 1% MBA, 0.1% ethylenediaminetetraacetic acid and a trace of wetting agent. After padding to 100-130% wet weight gain, samples were treated as in Example 20. Results are summarized below.

TABLE VII

| Type of Fabric Cotton (%) | Polyester (%) | Add-on (%) | Treated Fabric Efficiency (%) | Char Length (in.) |
|---|---|---|---|---|
| 100 | 0 | 42.7 | 68.6 | 2.6 |
| 80 | 20 | 46.9 | 70.4 | 3.1 |
| 30 | 70 | 37.5 | 64.8 | 4.2 |

TABLE VII-continued

| Type of Fabric Cotton (%) | Polyester (%) | Add-on (%) | Treated Fabric Efficiency (%) | Char Length (in.) |
|---|---|---|---|---|
| 0 | 100 | 37.4 | 65.5 | BEL |

EXAMPLE 22

Cotton sateen fabrics were immersed in an aqueous solution containing 9.7% THPC, 12.5% BVP, 17.7% NMA, 4.3% urea and a trace of wetting agent. After padding to 110 to 115% wet weight gain, the fabrics were placed on frames, dried for 4 minutes at 85°C, cured for 4 minutes at 150°C, washed and air dried. The following results were obtained; 31.9% fixed polymer, 67.7% efficiency of conversion of monomers to polymer, and 180° match test angle.

EXAMPLE 23

Cotton sateen fabric was immersed in a solution containing 15% THPC, 15% BVP, 15% acrylamide, 10% TMM, and a trace of wetting agent. After processing as in Example 20, the fabric was found to contain 37.4% fixed polymer add-on; the efficiency of conversion of monomers to polymer was 65.6%. The fabric had a char length of 2.7 inches. After subjection of the treated fabric to a 4-hour phosphate boil, a loss of only 9.0% polymer was observed; the vertical flame test indicated a char length of 1.8 inches.

EXAMPLE 24

Cotton fabrics were padded with solutions containing 25% BVP; 25% acrylamide or N-methylolacrylamide, and 2.5% MBA (no ammonium persulfate), dried for 4 minutes at 85°C and cured for 4 minutes at 150°C. After washing and air drying, fabrics were found to have a 3% add-on with each treating solution.

When 1.0% THPC was added to a solution containing 25% DVP, 25% acrylamide and 2.5% MBA, polymerization occurred before the fabrics could be padded. When fabric was processed as above using solutions containing 25% BVP, 25% NMA, 2.5% MBA, and 1.0% or 2.0% THPC, add-ons of 5.6% and 12.2% respectively were obtained. Higher concentrations of THPC produced addons as illustrated in other examples presented for reagent systems involving both THPC and BVP.

EXAMPLE 25

Cotton fabric was finished by the general procedure described in Example 24. The data that are summarized in Table VIII illustrate the attractive combinations of flame retardance, wrinkle recovery angles, and retention of breaking strength that are characteristic of this finishing system.

TABLE VIII

| Reagent System | Add-on % | Effic. % | Char Length | Breaking Strength % Ret. | Wrinkle Recovery Dry | Wrinkle Recovery Wet |
|---|---|---|---|---|---|---|
| 15% THPC/15% BVP/15% NMA/ 5% Urea/1% MBA | 36.6 | 64.0 | 3.9 | 79.1 | 273.3 | 277.7 |
| 9.7% THPC/12.5% BVP/17.7% NMA/4.3% Urea | 31.9 | 67.7 | 4.0 | 80.0 | 290.3 | 275.7 |
| 15% THPC/15% NMA/ 5% Urea/1% MBA/0.1% ethylenediaminetetra-acetic acid | 32.1 | 66.2 | 4.8 | 74.1 | 274.7 | 279.3 |
| 10% TMM | 37.4 | 65.6 | 2.7 | 87.5 | 249.3 | 275.3 |

We claim:

1. A process for preparing cellulosic, cellulosic blend or synthetic fiber fabric having flame retardancy and durable-press properties comprising:

a. wetting a cellulosic, cellulosic blend or synthetic fiber fabric in an aqueous solution containing tetrakis(hydroxymethyl) phosphonium chloride, a nitrogeneous containing compound selected from the group consisting of a N-methylol acrylamide and an acrylamide, and a vinyl monomer selected from the group consisting of methylenebisacrylamide and 1,3,5,tri-acryloylhexahydro-s-triazine; and b. curing the treated fabric from (a).

2. The product prepared by the process of Claim 1.

3. A process for preparing cellulosic, cellulosic blend, or synthetic fiber fabric having flame retardancy and durable-press properties comprising:

a. wetting a cellulosic, cellulosic blend or synthetic fiber fabric in an aqueous solution containing bis(2-chloro-ethyl)vinyl phosphonate, a nitrogenous containing compound selected from the group consisting of a methylolacrylamide and an acrylamide and a vinyl monomer selected from the group consisting of methylenebisacrylamide and 1,3,5,triacrylolhexahydro-s-triazine and ammonium or alkali metal persulfate, and b. curing the treated fabric from (a).

4. The product prepared by the process of Claim 3.

5. A process for preparing cellulosic, cellulosic blend, or synthetic fiber fabric having flame retardancy and durable-press properties comprising:

a. wetting a cellulosic, cellulosic blend or synthetic fiber fabric in an aqueous solution containing a phosphorus compound selected from the group consisting of tetrakis(hydroxymethyl)phosphonium chloride and bis(2-chloroethyl)vinyl phosphonate, and a nitrogenous containing compound selected from the group consisting of a N-methylol acrylamide and an acrylamide, and a vinyl monomer selected from the group consisting of methylenebisacrylamide and 1,3,5,triacrylol hexahydro-s-triazine; and b. curing the treated fabric from (a).

6. The product prepared by the process of Claim 5.

* * * * *